US009926119B1

(12) United States Patent
Honeycutt

(10) Patent No.: US 9,926,119 B1
(45) Date of Patent: Mar. 27, 2018

(54) PROTECTIVE END CAP

(71) Applicant: Heath Honeycutt, Chamblee, GA (US)

(72) Inventor: Heath Honeycutt, Chamblee, GA (US)

( * ) Notice: Subject to any disclaimer, the term of this patent is extended or adjusted under 35 U.S.C. 154(b) by 0 days.

(21) Appl. No.: 15/398,465

(22) Filed: Jan. 4, 2017

(51) Int. Cl.
*B65D 59/06* (2006.01)
*A63B 71/02* (2006.01)
*A47B 91/00* (2006.01)

(52) U.S. Cl.
CPC ..... *B65D 59/06* (2013.01); *A47B 91/00* (2013.01); *A63B 71/02* (2013.01)

(58) Field of Classification Search
CPC ..... B65D 59/06; B65D 59/08; F16L 57/005; F16L 55/115; F16L 55/1157; F16L 47/10
See application file for complete search history.

(56) References Cited

U.S. PATENT DOCUMENTS 1,347,765 A * 7/1920 Shrum ..... B65D 59/06 138/96 R
1,756,167 A * 4/1930 Avery ..... B65D 59/00 138/96 T
1,783,893 A 12/1930 Unke
3,160,175 A 12/1964 Laemmle
3,405,839 A * 10/1968 Saarem ..... F16L 55/1157 220/293
3,744,528 A 7/1973 Vestal
3,802,466 A * 4/1974 Panella ..... F16L 55/115 138/89
3,840,052 A * 10/1974 Schmidt ..... B65D 59/08 138/96 T
3,847,183 A 11/1974 Meyer
4,112,979 A 9/1978 Widdicombe
5,352,383 A * 10/1994 Johnson ..... B65D 59/06 106/14.13
5,653,447 A * 8/1997 Cress ..... F16J 15/025 215/270
5,850,854 A * 12/1998 Carroll ..... F16L 55/115 138/158
6,520,212 B1 2/2003 Blivet
6,854,616 B2 * 2/2005 Steffan ..... B65D 59/06 215/254
7,284,770 B2 * 10/2007 Dell'erba ..... B65D 59/06 138/96 T
7,503,591 B2 * 3/2009 Beeren ..... F16L 21/08 239/159
7,727,593 B2 6/2010 Zeyfang
8,006,856 B2 * 8/2011 Imai ..... F16L 55/115 220/233

(Continued)

*Primary Examiner* — Bradley Duckworth
(74) *Attorney, Agent, or Firm* — Fish & Richardson P.C.

(57) ABSTRACT

A protective end cap has a sleeve portion and a distal portion connected to an end of the sleeve portion. The sleeve portion includes one or more recessed portions in which an elastomer material is received and extends above an interior surface of the sleeve portion. The distal portion defines an exterior surface and an interior abutment surface that is substantially perpendicularly disposed relative to the interior surface of the sleeve portion. When the sleeve portion receives a first length of a rod member, the rod member abuts the abutment surface and the elastomer material is compressed between the recessed portion and a side surface of the rod member to frictionally retain the rod member within the sleeve portion.

13 Claims, 4 Drawing Sheets

(56) References Cited

U.S. PATENT DOCUMENTS

| | | | | |
|---|---|---|---|---|
| 2006/0081300 | A1* | 4/2006 | Schmalz | F16L 55/115<br>138/90 |
| 2009/0121475 | A1* | 5/2009 | Esser | B65G 53/52<br>285/23 |
| 2014/0157840 | A1* | 6/2014 | Martinelli | F16L 55/1157<br>70/163 |
| 2014/0261849 | A1* | 9/2014 | Danneffel | B65D 59/06<br>138/96 T |

* cited by examiner

SECTION C-C

SECTION A-A

SECTION B-B

PROTECTIVE END CAP

BACKGROUND

End caps are often used on round or rectangular tubular structures to either protect surfaces from the edges of the tubular structures, to protect the end of the tubular structures, or to simultaneously perform both functions. Likewise, objects can be protected from the ends of the tubular structures by the end caps.

End caps can be affixed to the tubular structures in a variety of ways. For example, for threaded tube ends, the end caps may have mating threads and be screwed on to the tube ends. For smooth round tube ends, the end caps may be friction fit by designing the end cap to have an interior diameter that matches (or is slightly smaller than) the outer diameter of the round tube. A similar fitting process can be used for rectangular shaped tubes. Friction fitted end caps, however, tend to be pulled off the tube ends when the tube ends form a base structure and the end caps are used to provide support surfaces for the structure. Examples of such structures are clothing racks for displaying clothes, L-screens, protective screens, pitching screens for baseball and softball coaching, and other structures used in a variety of different settings and that are often moved by being dragged across surfaces.

One solution is to design the end cap to be tightly fitted by under sizing the interior diameter of the end cap; however, attachment and removal of undersized end caps can be difficult. This problem is exacerbated if numerous end caps are replaced frequently.

SUMMARY

This specification describes technologies relating to a protective end cap that has a sleeve portion and a distal portion connected to an end of the sleeve portion. The sleeve portion includes one or more recessed portions in which an elastomer material is received and extends above an interior surface of the sleeve portion. The distal portion defines an exterior surface and an interior abutment surface that is substantially perpendicularly disposed relative to the interior surface of the sleeve portion. When the sleeve portion receives a first length of a rod member, the rod member abuts the abutment surface and the elastomer material is compressed between the recessed portion and a side surface of the rod member to frictionally retain the rod member within the sleeve portion.

In general, one innovative aspect of the subject matter described in this specification can be embodied in an end cap apparatus that includes a sleeve portion having a first length and defined by an outer periphery and an inner periphery, the outer periphery defining a first exterior surface, and the inner periphery defining a first interior surface and an opening to receive a distal portion of a rod member; a distal portion connected to an end of the sleeve portion and defining a second exterior surface and an interior abutment surface that is substantially perpendicularly disposed relative to the first interior surface; wherein the first interior surface of the sleeve portion includes a first recessed portion spaced apart from the interior abutment surface; and an elastomer material received in the first recessed portion and extending above the first interior surface; whereby upon the sleeve portion fully receiving a first length of the distal portion of the rod member, the distal portion of the rod member abuts the abutment surface and the elastomer material is compressed between the first recessed portion and a side surface of the rod member to frictionally retain the distal portion of the rod member within the sleeve portion.

Another innovative aspect of the subject matter described in this specification can be embodied in an end cap apparatus that includes a sleeve portion having a first length and defined by an outer periphery and an inner periphery, the outer periphery defining a first exterior surface, and the inner periphery defining a first interior surface and an opening to receive a distal portion of a rod member; a distal portion connected to an end of the sleeve portion and defining a second exterior surface and an interior distal portion surface; wherein the first interior surface of the sleeve portion includes a first recessed portion spaced apart from the interior distal portion surface and a second recessed portion oppositely opposed the first recessed portion and also spaced apart from the interior distal portion surface; and an elastomer material received in the first recessed portion and in the second recess portion and extending above the first interior surface; whereby upon the sleeve portion fully receiving at least first length of the distal portion of the rod member, elastomer material is compressed between the first recessed portion and a side surface of the rod member to frictionally retain the distal portion of the rod member within the sleeve portion.

Particular embodiments of the subject matter described in this specification can be implemented so as to realize one or more of the following advantages. Because most of the retention force is provided by the elastomer material, and the elastomer material is disposed near, but spaced apart from, the interior abutment surface, the end cap may more easily be attached and removed from the tube end. Moreover, placing the elastomer material near the abutment surface, and thus near the end of the tube received by the end cap, causes load pressure to increase on the elastomer material when the structure is moved, thereby increasing retentive force when the structure is being dragged across a surface. Additionally, by using separate but opposed recessed sub-sections of the inner periphery instead of a continuous O-ring, the force to attach and remove the end cap by hand is reduced, but the retention of the end cap when attached the end of tube and being dragged is only minimally impacted. Additionally, the use of separate but opposed recessed sub-sections and respective elastomer material facilitates easier attachment and removal by twisting as opposed to use of a full O-ring.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
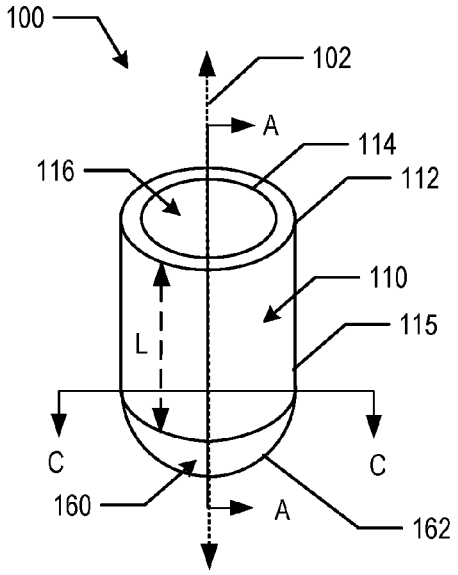
FIG. 1 is a top perspective view of an end cap.
Figure 2:
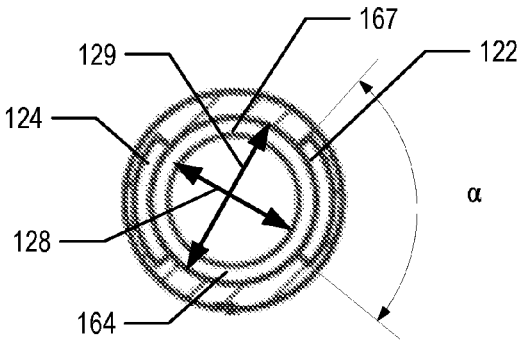
FIG. 2 is a top cross-section view of the end cap.
Figure 3:
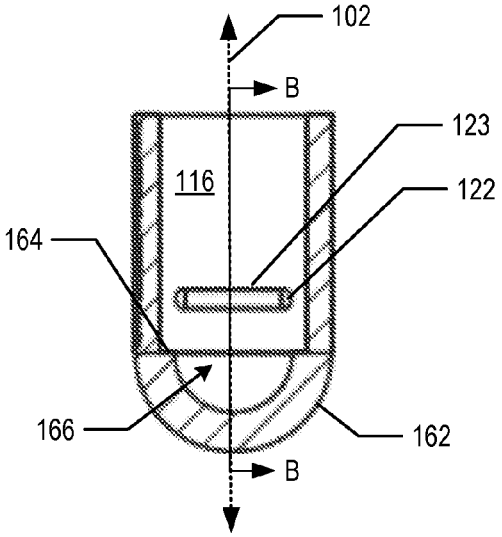
FIG. 3 is a first side cross-section view of the end cap.
Figure 4:
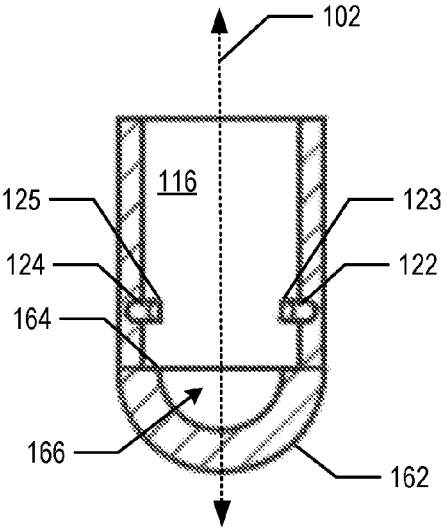
FIG. 4 is a second side cross-section view of the end cap.

FIG. 1 is a top perspective view of an end cap 100, and FIGS. 2-4 are top and side cross-section views of the end cap 100. Although the example end cap 100 depicted in FIGS. 1-4 is designed to fit on the distal portion of a round tube, the features of the end cap can also be adopted for polygonal shaped tubes, such as triangular-shaped and rectangular shaped tubes. Thus, the features described below are not limited to applications for round tubes and bars, but are also applicable to polygonal shaped tubes and bars. Moreover, while the example member that is covered is a hollow tube, the end cap 100 may also be used on solid bars. Accordingly, the term "rod" is to be understood to encompass both hollow tubes and solid bars.

Moreover, while many features of the end cap 100 depicted in the drawings are described, descriptions of some structures depicted in the drawing are omitted for brevity. Furthermore, numbering of like features is omitted to avoid congestion in the drawings.

The end cap 100 may be manufactured from a variety of stiff plastics, such as polyethylene, Nylon, PVC or uPVC, and the like, wood, or even metal, such as aluminum, steel, and the like. The end cap 100 has a sleeve portion 110 and a distal portion 160 that are aligned along a longitudinal axis 102. The sleeve portion 110 has a first length L and is defined by an outer periphery 112 and an inner periphery 114. The outer periphery 112, in turn, defines a first exterior surface 115, and the inner periphery 114 defines a first interior surface 116 and an opening to receive a distal portion of a rod member.

The end cap 100 distal portion 160 is connected to an end of the sleeve portion 110. The distal portion 160, as shown in FIG. 1, forms a round exterior surface 162. Moreover, the distal portion 160 also forms an interior abutment surface 164 that is substantially perpendicularly disposed relative to the first interior surface 116. As will be described with reference to FIG. 5, the abutment surface 164 forms a ledge or surface that abuts the end surface of a rod member that is inserted into the end cap 100. The distal portion 160 may be solid, or, as shown in FIGS. 3 and 4, may have a hollowed portion formed by an interior cavity 166. The hollowed portion 166 has a periphery 167 such that a respective diameter 128 that forms the interior edge of the abutment surface 164 is smaller than the diameter 129 of the interior surface of the sleeve 110, as depicted in FIG. 2.

The interior surface 116 of the sleeve portion 110 includes at least one recessed portion 122 spaced apart from the interior abutment surface 164. As shown in FIGS. 2-4, the end cap 110 includes two oppositely-opposed recessed portions 122 and 124. Each extend along sub-sections of the inner periphery that are less than an entirety of the inner periphery, as depicted by the arcuate section a in FIG. 2. Within each recessed portion 122 and 124 is an elastomer material, depicted by elements 123 and 125. The elastomer material 123 and 125 extend above the first interior surface 116, as illustrated in FIGS. 3 and 4. An example elastomer material is rubber, but other materials that exhibit a low Young's modulus and high failure strain relative to the material used to make the end cap may also be used.

Figure 5:
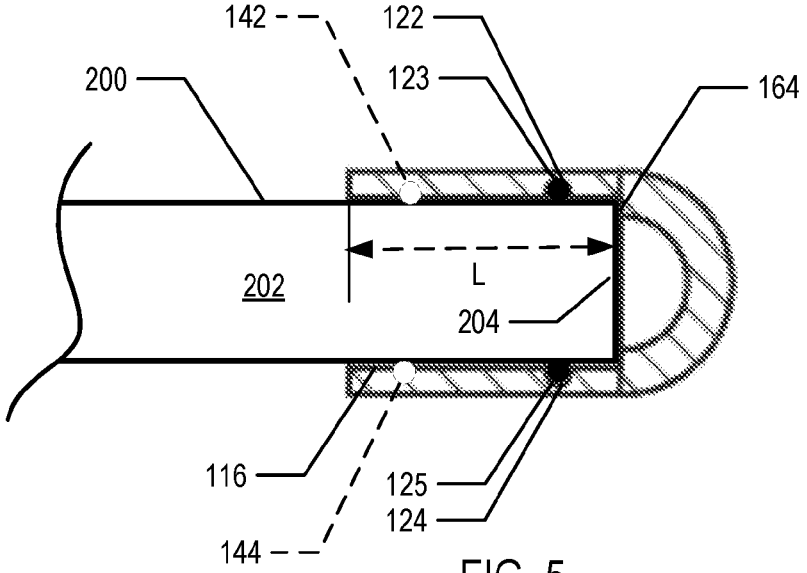
FIG. 5 is a cross-section view of the end cap placed on a distal portion of a rod.

FIG. 5 is a cross-section view of the end cap 100 placed on a distal portion of a rod 200. When the sleeve portion 110 fully receives a first length L of a distal portion of the rod 202, the distal portion of the rod 200, which terminates in the end surface 204 of the rod, abuts the abutment surface 164. The elastomer material 123 and 125 are compressed between the first recessed portions 122 and 124 and side surface 202 of the rod 200 to frictionally retain the distal portion of the rod 200 within the sleeve portion 200. To assist in retention, the interior diameter 129 of the sleeve 110 may be slightly undersized (when using a plastic) or matched (when using a plastic or metal) relative to the outer diameter of the rod 200.

Generally, the recessed portions 122 and 124 are depicted as being closer to the abutment surface 164 than the opening of the sleeve portion 110. However, in other implementations, the recessed portions may be closer to the opening of the sleeve portion 110 than to the abutment surface 164. Alternatively, the recessed portions 122 and 124 may be located mid-way between the opening of the sleeve portion 110 and abutment surface 164.

Moreover, more than one set of recessed portions may be used. For example, the sleeve portion 110 of FIG. 5 could have a second set of opposed recessed portions and elastomers located near the opening of the sleeve portion 110, as depicted by phantom elements 142 and 144.

Figure 6:
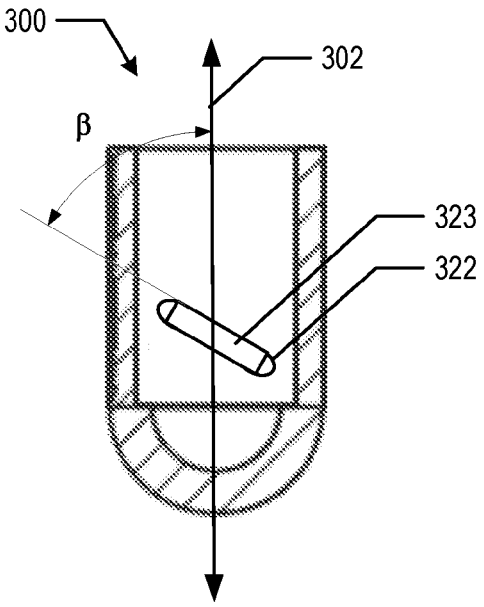
FIG. 6 is a side cross-section view of another implementation of an end cap.

Other variations can also be used. For example, in FIG. 6, which is a side cross-section view of another implementation of the end cap 300, the recessed portion 322 and the elastomeric material 323 may be disposed at an acute angle β relative to the longitudinal axis 302. This implementation differs from the end cap 100 of FIG. 3, which shows the recessed portion 122 and the elastomeric material 123 perpendicularly disposed relative to the longitudinal axis. In additional implementations, the recessed portion and the elastomeric material may be disposed parallel to the longitudinal axis 102.

Figure 7:
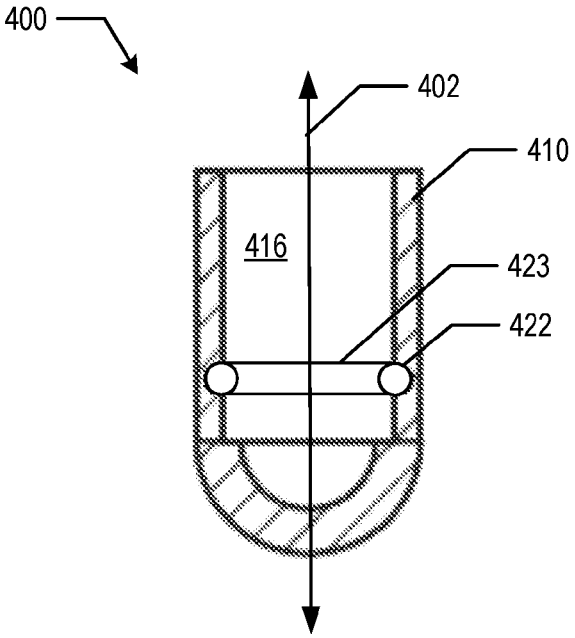
FIG. 7 is a side cross-section view of yet another implementation of an end cap.

Although the end caps of FIGS. 1-6 depict multiple recessed portions, one single recessed portion can be used. One such implementation is shown in FIG. 7, which is a side cross-section view of yet another implementation of the end cap 400. In this implementation, a circular recessed portion 422 forms a continuous recessed portion around the inner surface 416 of the sleeve portion 410. A rubber O-ring, for example, may then be used for the elastomer material 423.

In still over variations, a continuous recessed portion may form a looped path distributed at an angle relative to the longitudinal axis 402, forming a corkscrew-like path along the interior surface of the sleeve. Within the recessed portion the elastomer material may then be distributed.

Figure 8:
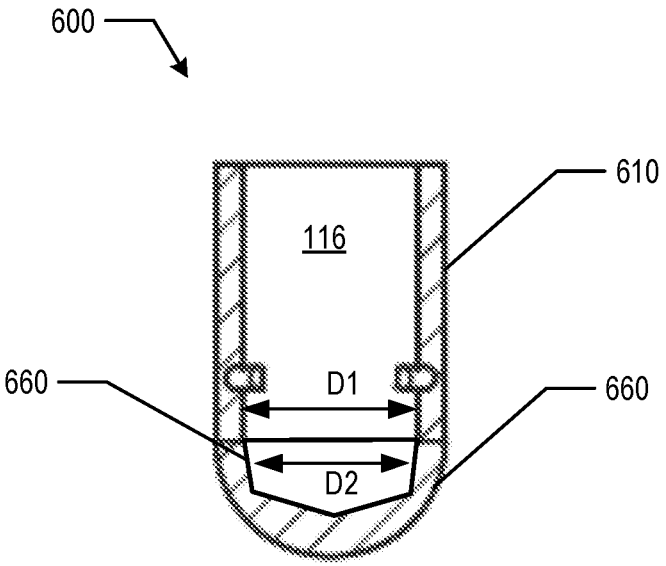
FIG. 8 is a side cross-section view of yet another implementation of an end cap.

In still other variations, the distal portion 160 need not define an abutment surface that is perpendicularly disposed relative to the interior surface 116 of the sleeve. Instead, the distal portion 160 may define an interior distal portion surface that includes a region in which the interior diameter gradually decreases from the interior diameter of the sleeve, and the rod member may be push-fit into the end cap 100. On such example of this implementation is illustrated in FIG. 8, which shows yet another implementation of an end cap 600. In this implementation, the interior diameter of the sleeve 610 is D1, and the distal portion 660 of the cap has interior surface 662 that forms a partially conical interior region that decreases in diameter from D1 to decreasing diameter D2. The end of a rod that is inserted into the end cap 600 will thus be push-fit into the conical portion defined by the surface 660.

Figure 9:
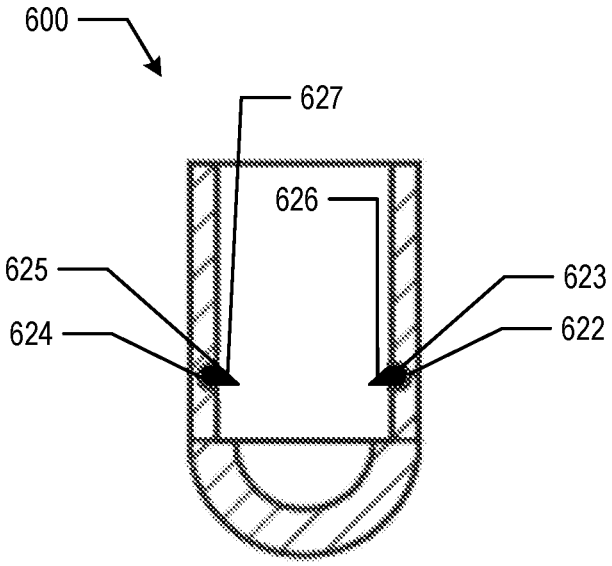
FIG. 9 is a side cross-section view of still another implementation of an end cap.

While the elastomer materials illustrated generally have a round or oval cross-section, other cross-section shapes can be used. For example, in FIG. 9, the end cap 600 includes recessed portions 624 and 625 that each have elastomer materials 623 and 625 with an angular cross-section. As show, the angular cross-sections form a relief surfaces 626 and 627 that angle toward the distal portion of the end cap and further facilitate ease of installation onto a rod but still provide retention after being installed. Other cross-sectional shapes, such as rectangular cross sections, can also be used.

Figure 10:
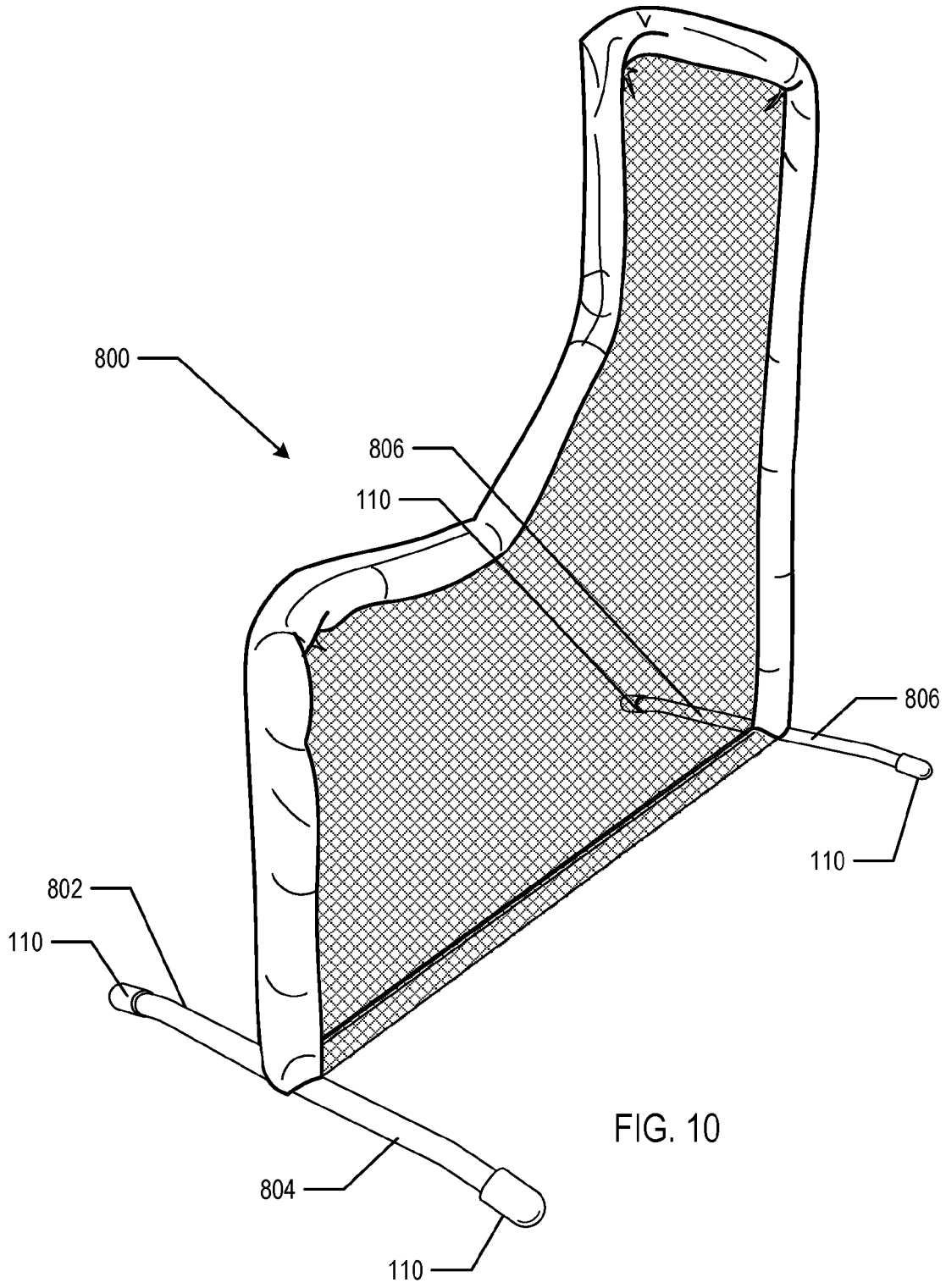
FIG. 10 is a perspective view of an L-screen with end caps attached to the ends of the tubular base sections.

There are multiple applications for the end caps described above. One such application is an end cap for an L-screen 800, as depicted in FIG. 10. The L-screen 800 has tubular members 802, 804, 806 and 808 that collectively form a base. Each member 802, 804, 806 and 808 is capped by an end cap 110. The end caps 110 facilitate slide the L-screen 800 over a variety of surfaces, including artificial turn. When the end caps 110 are manufactured using a plastic material, a polycarbonate may optionally be used to coat the end caps 110. The polycarbonate coating provides resistance to wear, which extend the life of the end caps 110.

The end caps 110, when attached to the L-screen 800, allow the L-screen 800 to slide easily across a turf surface given the hard exterior surface of the end caps 110. However, the end caps 110 are not pulled off the tubular members, such as would occur were the end caps 110 made of a softer, more elastomer material such as rubber. Finally, the end caps 110 also protect balls from damage that would otherwise occur were the tubular members left uncovered.

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. An end cap apparatus, comprising:

a sleeve portion having a first length and defined by an outer periphery and an inner periphery, the outer periphery defining a first exterior surface, and the inner periphery defining a first interior surface and an opening to receive a distal portion of a rod member;

a distal portion connected to an end of the sleeve portion and defining a second exterior surface and an interior abutment surface that is substantially perpendicularly disposed relative to the first interior surface;

wherein the first interior surface of the sleeve portion includes a first recessed portion spaced apart from the interior abutment surface and a second recessed portion spaced apart from the abutment surface, and wherein the first recessed portion and the second recessed portion each extend along sub-sections of the inner periphery that are less than an entirety of the inner periphery; and an elastomer material received in the first recessed portion and extending above the first interior surface;

an elastomer material received in the second recessed portion and extending above the first interior surface;

whereby upon the sleeve portion fully receiving a first length of the distal portion of the rod member, the distal portion of the rod member abuts the abutment surface and the elastomer material is compressed between the first recessed portion and a side surface of the rod member to frictionally retain the distal portion of the rod member within the sleeve portion.

2. The end cap apparatus of claim 1, wherein the first recessed portion and the second recessed portion are disposed substantially perpendicularly to a longitudinal axis that extends through the sleeve portion and the distal portion.

3. The end cap apparatus of claim 1, wherein the elastomer materials have a cross-section defining a relief surface that angle toward the distal portion of the end cap.

4. The end cap apparatus of claim 1, wherein the first recessed portion and the second recessed portion are disposed at an acute angle relative to a longitudinal axis that extends through the sleeve portion and the distal portion.

5. The end cap apparatus of claim 1, wherein the first recessed portion extends along the entirety of the inner periphery to define a continuous recessed portion.

6. The end cap apparatus of claim 1, wherein the outer periphery of the sleeve portion is circular.

7. The end cap apparatus of claim 1, wherein the outer periphery of the sleeve portion is rectangular.

8. The end cap apparatus of claim 1, wherein sleeve portion and distal portion are made of a metal.

9. The end cap apparatus of claim 1, wherein sleeve portion and distal portion are made of a plastic.

10. An end cap apparatus, comprising:

a sleeve portion having a first length and defined by an outer periphery and an inner periphery, the outer periphery defining a first exterior surface, and the inner periphery defining a first interior surface and an opening to receive a distal portion of a rod member;

a distal portion connected to an end of the sleeve portion and defining a second exterior surface and an interior distal portion surface;

wherein the first interior surface of the sleeve portion includes a first recessed portion spaced apart from the interior distal portion surface and a second recessed portion oppositely opposed to the first recessed portion and also spaced apart from the interior distal portion surface, and wherein the first recessed portion and the second recessed portion extend along sub-sections of the inner periphery that are less than an entirety of the inner periphery; and an elastomer material received in the first recessed portion and in the second recessed portion and extending above the first interior surface;

whereby upon the sleeve portion fully receiving at least a first length of the distal portion of the rod member, the elastomer material is compressed between the first recessed portion and a side surface of the rod member to frictionally retain the distal portion of the rod member within the sleeve portion.

11. The end cap apparatus of claim 10, wherein the interior distal portion surface includes a region in which an interior diameter of the interior distal portion surface gradually decreases from an interior diameter of the sleeve portion.

12. The end cap apparatus of claim 11, wherein the first recessed portion and the second recessed portion are disposed substantially perpendicularly to a longitudinal axis that extends through the sleeve portion and the distal portion.

13. The end cap apparatus of claim 11, wherein the first recessed portion and the second recessed portion are disposed at an acute angle relative to a longitudinal axis that extends through the sleeve portion and the distal portion.

* * * * *